US007727081B1

(12) United States Patent
McConnell

(10) Patent No.: US 7,727,081 B1
(45) Date of Patent: Jun. 1, 2010

(54) PENDULUM PUTTING STROKE TRAINING AID

(75) Inventor: William Dean McConnell, 3205 Ridge Oak Dr., Garland, TX (US) 75044

(73) Assignee: William Dean McConnell, Garland, TX (US)

( * ) Notice: Subject to any disclaimer, the term of this patent is extended or adjusted under 35 U.S.C. 154(b) by 824 days.

(21) Appl. No.: 11/636,130

(22) Filed: Dec. 8, 2006

Related U.S. Application Data

(60) Provisional application No. 60/750,943, filed on Dec. 16, 2005.

(51) Int. Cl.
*A63B 57/00* (2006.01)

(52) U.S. Cl. ..... 473/222

(58) Field of Classification Search ..... 473/222, 473/221, 252, 257; 273/108, 108.2
See application file for complete search history.

(56) References Cited

U.S. PATENT DOCUMENTS

| | | | | |
|---|---|---|---|---|
| 3,808,707 | A | 5/1974 | Fink | |
| 5,040,790 | A | 8/1991 | Anthes | |
| 5,082,281 | A | 1/1992 | Berghofer | |
| 5,423,538 | A | 6/1995 | Stewart | |
| 5,558,519 | A | 9/1996 | Sabowitz | |
| 5,743,807 | A | 4/1998 | Bendo | |
| 5,772,522 | A * | 6/1998 | Nesbit et al. | 473/222 |
| 5,797,805 | A * | 8/1998 | Lubell et al. | 473/266 |
| 5,984,684 | A * | 11/1999 | Brostedt et al. | 434/252 |
| 6,517,352 | B2 | 2/2003 | Smith | |
| 6,565,448 | B2 * | 5/2003 | Cameron et al. | 473/131 |
| 6,669,571 | B1 * | 12/2003 | Cameron et al. | 473/131 |
| 7,255,649 | B1 * | 8/2007 | McConnell | 473/199 |
| 7,311,611 | B2 * | 12/2007 | Cameron et al. | 473/221 |
| 7,503,858 | B2 * | 3/2009 | Cameron | 473/407 |
| 2004/0214651 | A1 | 10/2004 | Park | |

* cited by examiner

*Primary Examiner*—Ronald Laneau

(57) ABSTRACT

An apparatus for indicating the proper pendulum putting stroke to a golfer with An elongated display device that is positioned on a floor parallel to the stroke path of the practicing golfer, A display device containing multiple microcontroller module sections, each containing visual indicators spaced uniformly along the length of the sections, Each section being responsive to commands from a peripheral computing device to turn on a specific visual indicator, a peripheral computing device such as a personal computer running a computer program which calculates the putting stroke based on desired distance, green speed, and the golfer's personal rhythm rate in beats per minute, A peripheral computing device that after calculating the putting stroke time-position data, commands the display device to turn on and off consecutive visual indicators at a predefined time in such a way as to display a putting stroke path, and show the golfer the proper time-space dynamics to strike a golf ball a desired distance.

11 Claims, 12 Drawing Sheets

FIG. 6
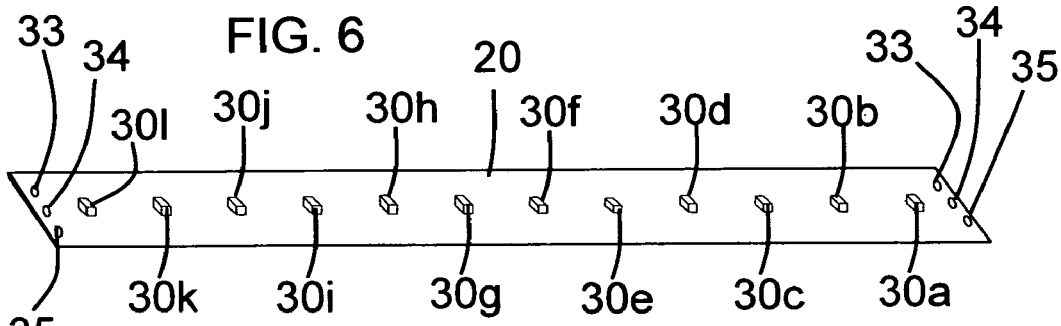
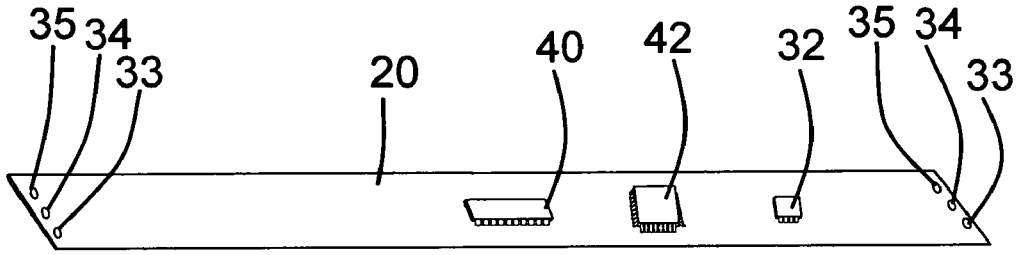
FIG. 7
FIG. 8
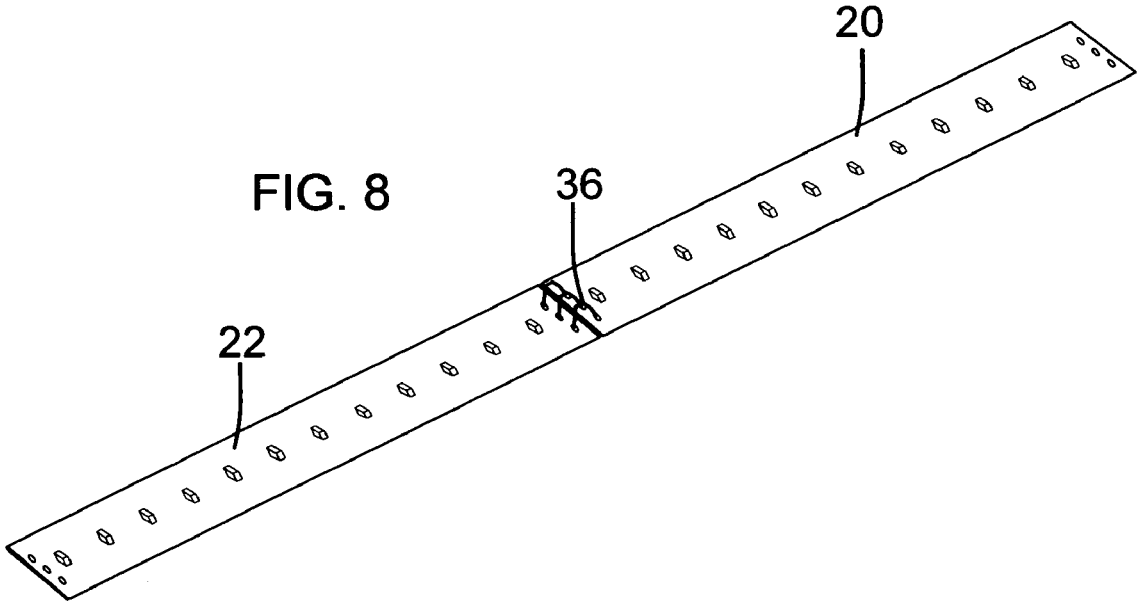

PENDULUM PUTTING STROKE TRAINING AID

CROSS REFERENCE TO RELATED APPLICATIONS

This application claims the benefit of provisional application Ser. No. 60/750,943 filed on Dec. 16, 2005.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of golf training aids and more specifically to an apparatus for indicating the proper pendulum putting stroke to a golfer. It has been known for quite some time since the advent of modern era golf greens, that the pendulum stroke is the preferred putting stroke. Before greens were fast and smooth, a wristy, hands dominated putting stroke was used by most professional golfers. With the development of smooth golf greens through agricultural grass research that has produced grass strains with fine blades that allow shorter mower cuts, a putting stroke which locks the wrists and uses the large muscles in the arms and shoulders has been adopted by the vast majority of golf professionals. This arms oriented stroke has been named the pendulum putting stroke. Almost every expert in golf instruction recommends the pendulum stroke yet, no one can actually show a golfer exactly what it is. Metronomes are usually suggested as a means of teaching a golfer how to keep a consistent back and forth rhythm. A pendulum putting stroke takes the same time to travel from the top of the backswing though impact to the top of the followthrough regardless of the putting stroke length, so golfers practice short strokes, medium strokes, and long strokes while listening to a metronome's tick tock sound. The top of the backswing is reached at the tick and the downswing is completed at the tock. Looking to the pendulum as an analog to the putting stroke, leading golf instructors see the pendulum's smooth acceleration and constant timing as an ideal device to emulate in putting.

Prior tempo training aides consist of devices that provide audio, visual, or vibration signals that indicate various points in the golf swing. Most indicate the beginning, backswing, and downswing phases of a full golf swing or putting stroke. Metronome devices indicate the timing between the two endpoints of the golf stroke, the top of the backswing to the end of the downswing. For a putting stroke, the metronome tick sound corresponds to the top of the backswing while the tock sound corresponds to the end of the downswing. Five U.S. patents disclose audible sound producing metronomes either worn by the golfer, placed near the golfer or placed inside the golf club handle including U.S. Pat. No. 5,743,807 to Bendo, U.S. Pat. No. 5,082,281 to Berghofer, U.S. Pat. No. 5,040,790 to Anthes, U.S. Pat. No. 3,808,707 to Fink, and U.S. Pat. No. 6,517,352 to Smith. One approach, U.S. Pat. No. 5,558,519 to Sabowitz, provides an audio or visual indication for the start of the backswing, the half swing point, the top of the backswing, and the impact point on the downswing. U.S. Pat. No. 5,423,538 describes a putting trainer that has a microswitch onto which the toe of a putter contacts in order to detect the start of the backswing when the putter is moved and the microswitch opens. Adjustment knobs set the time duration of the backswing and the downswing. Control circuitry produces a sensible signal, which is described by the inventor as a visual or audible signal detected by the golfer, at the top of the backswing and at the end of the downswing. Still another approach, U.S. Pat. Application Publication No. US 2004/0214651 A1 to Park provides a tone or vibration to indicate the start and duration of the backswing, followed by a tone or vibration to indicate the start and duration of the downswing. A series of Leds arranged in a circular fashion on the front of the display indicate for the purposes of adjustment setup, the timing of the backswing and downswing that will be executed when placed in the audio or vibration mode.

Prior putting tempo training aids suffer several disadvantages. Most of the training aids relate to the full golf swing and not specifically to the putting stroke. If applied to the putting stroke, the simpler training aids that output an audible or visual indicator at the top of the backswing and the end of the downswing provide only two data points in the overall putting stroke dynamic. These aids fail to indicate to the golfer where the putter should be between the two points. U.S. Patent Application Publication No. US 2004/0214651 A1 provides an audio beep or buzzer for the backswing start, top of the swing pause, and start of the downswing. A series of LEDs, in LED mode, placed in a small circle on the outside of the housing depicts 17 positions in a full swing pattern that flash on in sequence to indicate the backswing and downswing timing selected by the golfer prior to actual use. However, the LEDs are only viewed for device setup and are not watched while making a full swing. The Led sequence's purpose is not to show the golfer a detailed time position guide to strike a ball a desired distance. Furthermore, a full swing depiction does not provide a golfer with a relevant putting stroke guide. Although these aids provide tempo signals that aid a golfer in building a repeatable stroke, they do not show the golfer how to execute a putting stroke that will roll a golf ball a desired distance. It is the goal of the present invention to indicate to the golfer through a series of visual indicators, the proper pendulum stroke dynamics to produce a desired distance putt on a green of known green speed and with a personal putting tempo in beats per minute. Using the present invention, a golfer enters the green speed, beats per minute, and the desired distance and by following the resulting LED sequence pattern with his/her putter, will learn the backswing and downswing dynamics to stroke a golf ball a desired distance.

BRIEF SUMMARY OF THE INVENTION

The primary object of the invention is to visually indicate to a golfer, the proper putting stroke time-position relationship for a given green speed, desired distance, and golfer's personal putting stroke frequency in beats per minute.

Another object of the invention is to show a golfer how to produce a "perfect pendulum" putting stroke.

Another object of the invention is to indicate the length of the backswing and downswing to produce a putt that rolls a desired distance.

Still another object of the invention is to allow a golfer to practice short, medium, and long putts in a small indoor space such as an office, hotel room, or den.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus for indicating the proper pendulum putting stroke to a golfer comprising: An elongated display device that is positioned on a floor parallel to the stroke path of the practicing golfer, A display device containing multiple microcontroller modules, each containing multiple light emitting diodes spaced uniformly along the length of the sections, Each section being responsive to commands from a peripheral computing device to turn on a specific LED, a peripheral computing device such as a personal computer running a computer program which calculates the putting stroke based on desired distance, green speed, and the golfer's personal putting tempo rate in beats per minute, A peripheral computing device that after calculating the putting stroke time-position data, commands the display device to turn on and off consecutive LEDs at a predefined time in such a way as to display a putting stroke path that will yield a putt length equal to the target distance that the golfer entered on the graphical user interface of the peripheral computing device.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 6 is a perspective view of the top side of the first of four microcontroller modules showing the LEDs and module to module interconnecting pins.

FIG. 7 is a perspective view of the bottom side of the first of four microcontroller modules showing the microcontroller, and USB integrated circuits.

FIG. 8 is a perspective of the first and second microcontroller modules showing the three wire power and communication bus connections.

FIG. 10 is used to support the derivation of equations of the desired putterhead motion for the LEDs that guide the golfer's putting stroke.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
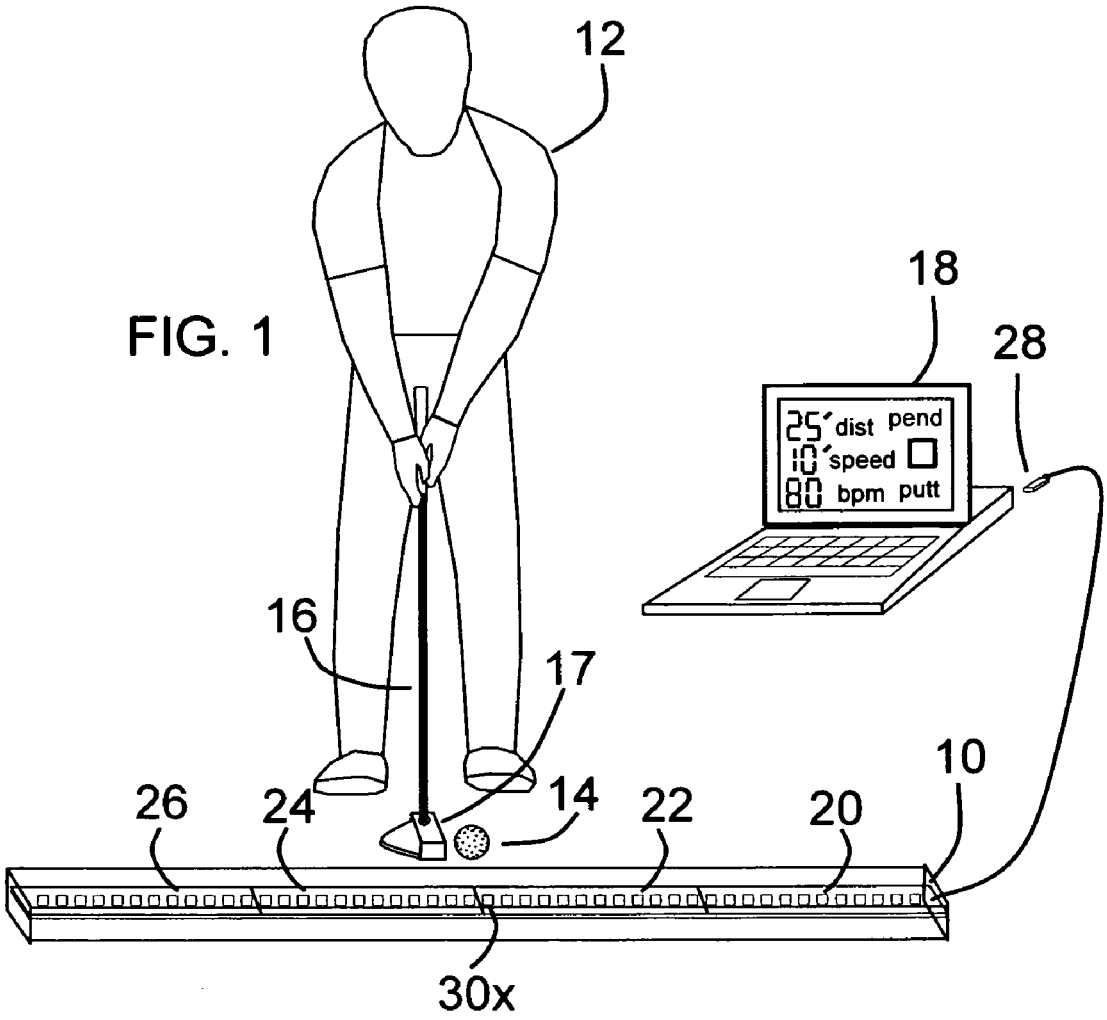
FIGS. 1-3 are perspective views of the invention illustrating how a golfer would use the Pendulum Putting Stroke Training Aid.
Figure 2:
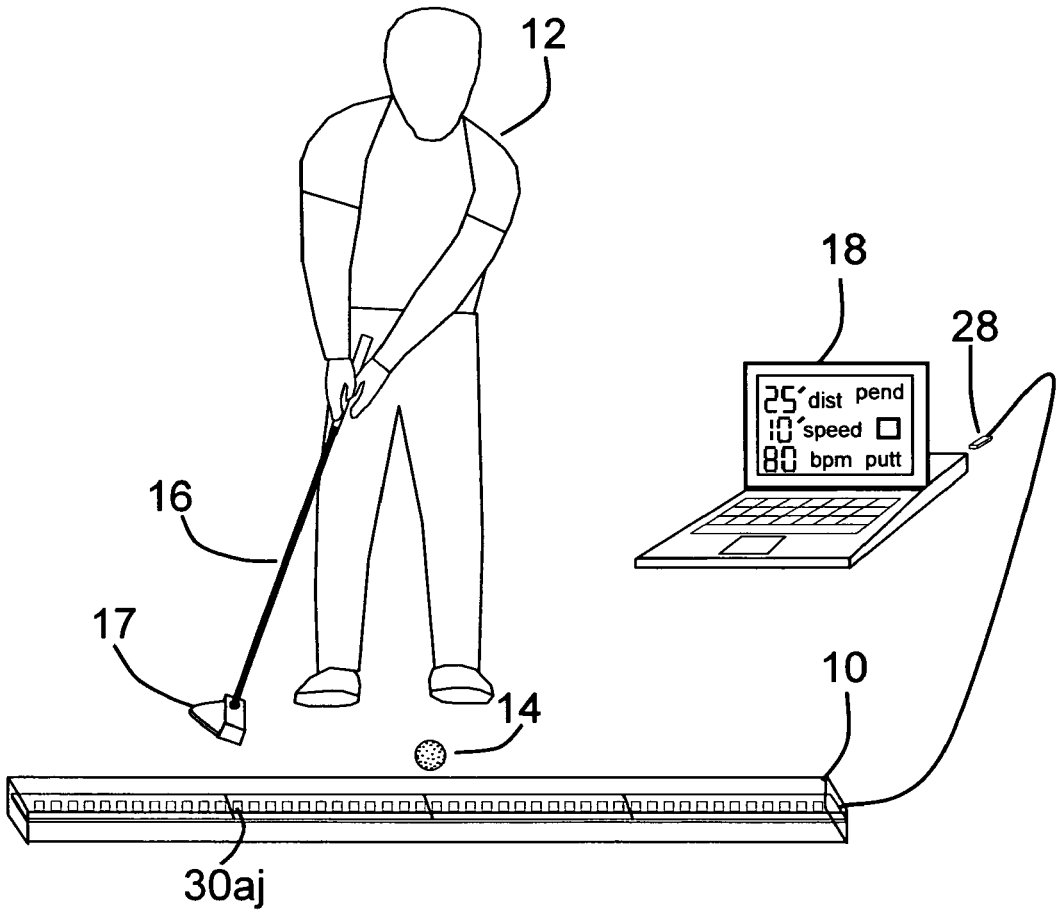
Figure 3:
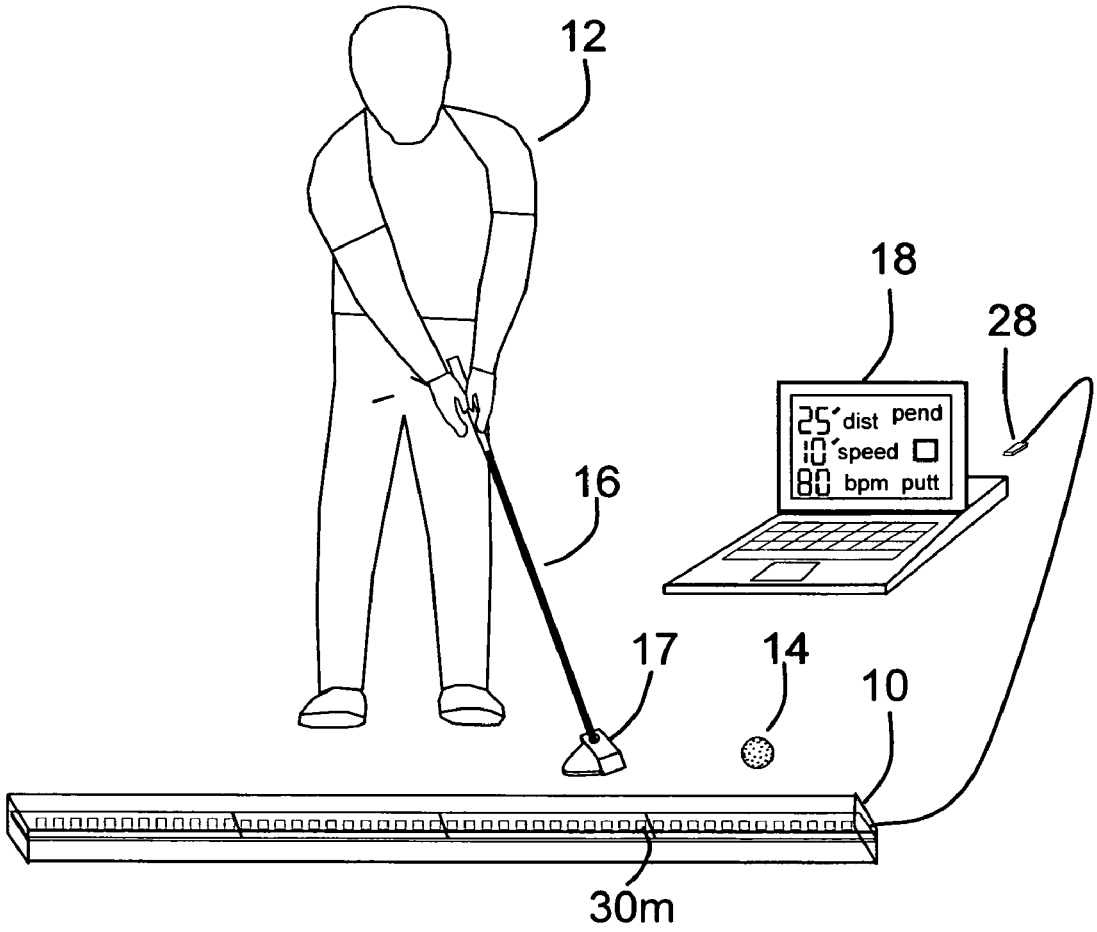
Figure 9:
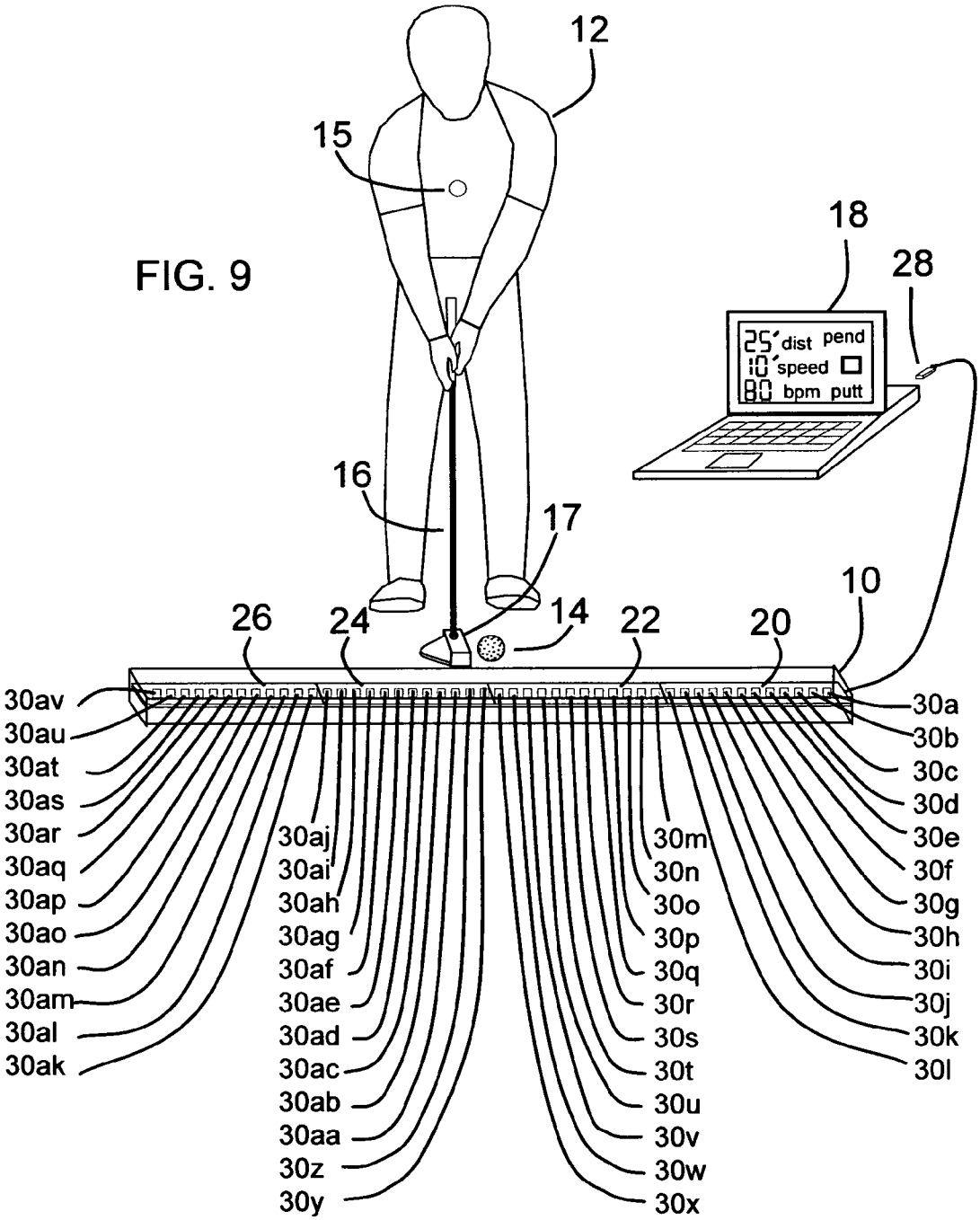
FIG. 9 is a drawing of the invention illustrating each of the 48 LEDs comprising a four microcontroller module Pendulum Putting Stroke Trainer.

Turning first to FIG. 1 there is shown a golfer 12 preparing to strike golf ball 14 with putterhead 17 of putter 16. There is also shown in FIG. 1, a Pendulum Putting Stroke Training Aid housing 10 for indicating to golfer 12, the proper time-position motion that the putterhead 17 should follow to strike golf ball 14 with sufficient energy to roll the ball 14 a desired length. Pendulum Putting Stroke Training Aid housing 10 is placed on the ground parallel and just outside the path of the golfer's stroke such that starting LED 30*x* is directly across from golf ball 14 at the golfer's address position. Peripheral control cable 28 connects to the USB port of personal computer 18. In the Putting Stroke Mode, LED 30*x* turns on momentarily to indicate to golfer 12 that the putting stroke cycle will begin shortly. Golfer 12 begins to take putter 16 back away from golf ball 14 which is placed near LED 30*x* while watching Pendulum Putting Stroke Training Aid housing 10 in the vicinity of starting LED 30*x* for the indication of the beginning of the putting stroke. In this embodiment, there are a total of 48 LEDs ranging from LED 30*a* to 30*av* as shown in FIG. 9. Returning back to FIG. 1, each of the four microcomputer modules 20, 22, 24, 26 contain a total of twelve LEDs each. This provides one LED per inch. It should be apparent to those skilled in the art that the number of LEDs per inch as well as the total number of microcontroller modules could be increased or decreased. Prior to addressing golf ball 14 for the purpose of putting training, golfer 12 enters the desired target distance of the roll of golf ball 14, the green speed, and the personal putting stroke tempo in beats per minute (bpm) into the graphical user interface software program running on personal computer 18. Before the putting stroke begins, personal computer 18 calculates the time between the activation of LEDs. Referring to FIG. 9, during the putting stroke, personal computer 18 communicates LED activation commands to Pendulum Putting Stroke Training Aid housing 10 over the USB port through peripheral control cable 28 indicating to golfer 12, the proper pendulum putting stroke by illuminating specific LEDs 30*a*-30*av* one at a time in precise sequence to match the time-position dynamics of a pendulum in motion as adjusted by the golfer's personal tempo. By following the activated LED 30*a*-30*av* position with putterhead 17 of putter 16, the golfer 12 can execute a pendulum putting stroke that will yield a golf ball 14 roll distance equal to the target distance set by golfer 12 on personal computer 18. Pendulum fulcrum 15 is the virtual base of the pendulum formed by golfer 12 and putter 16. FIG. 2 shows golfer 12 at the top of the backswing portion of an example putting stroke whereby the last LED in the stroke is LED 30*aj*. In this example pendulum stroke, golfer 12 stops putter 16 backswing progress at LED 30*aj*. Personal computer 18 then sends LED commands over the USB port through peripheral control cable 28 to Pendulum Putting Stroke Training Aid housing 10 to start the downswing portion of the putting stroke. Each successive LED is activated one at a time until the LED lined up with the initial starting position of the ball is reached at which time golfer strikes ball 14 with putterhead 17. In FIG. 3 the end of the example putting stroke is shown. Putter 16 and putterhead 17 is lined up with LED 30*m* which in this example, activates at the end of the putting stroke mode as commanded by personal computer 18 over the USB port through peripheral control cable 28 to indicate the end of the putting stroke arc and ball 14 is rolling past the end of the Pendulum Putting Stroke Training Aid housing 10.

Figure 4:
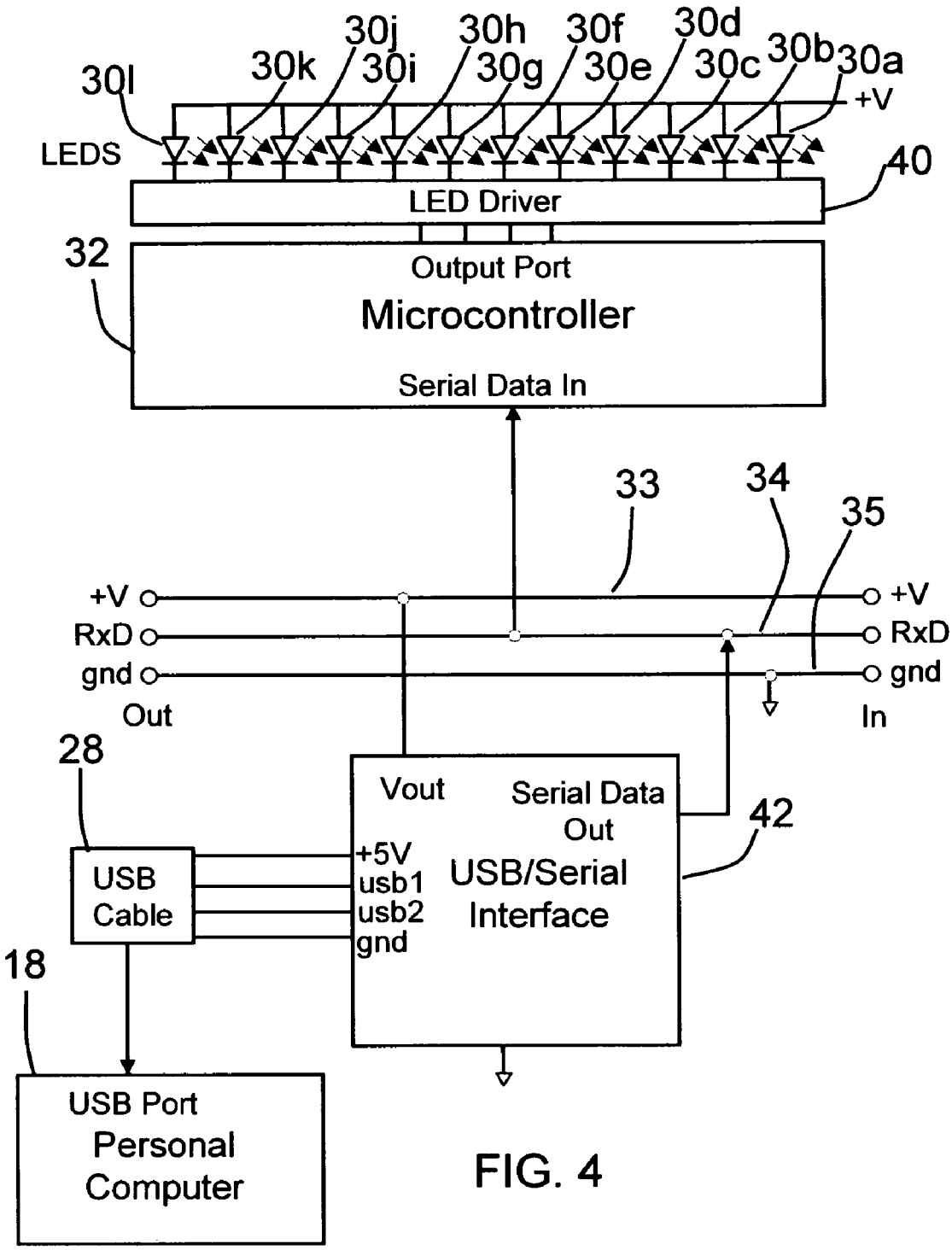
FIG. 4 is a block diagram schematic of a single microcontroller module and its connection to a peripheral computing device which in the present embodiment is a personal computer. The connection in the present embodiment is a universal serial bus link USB.
Figure 5:
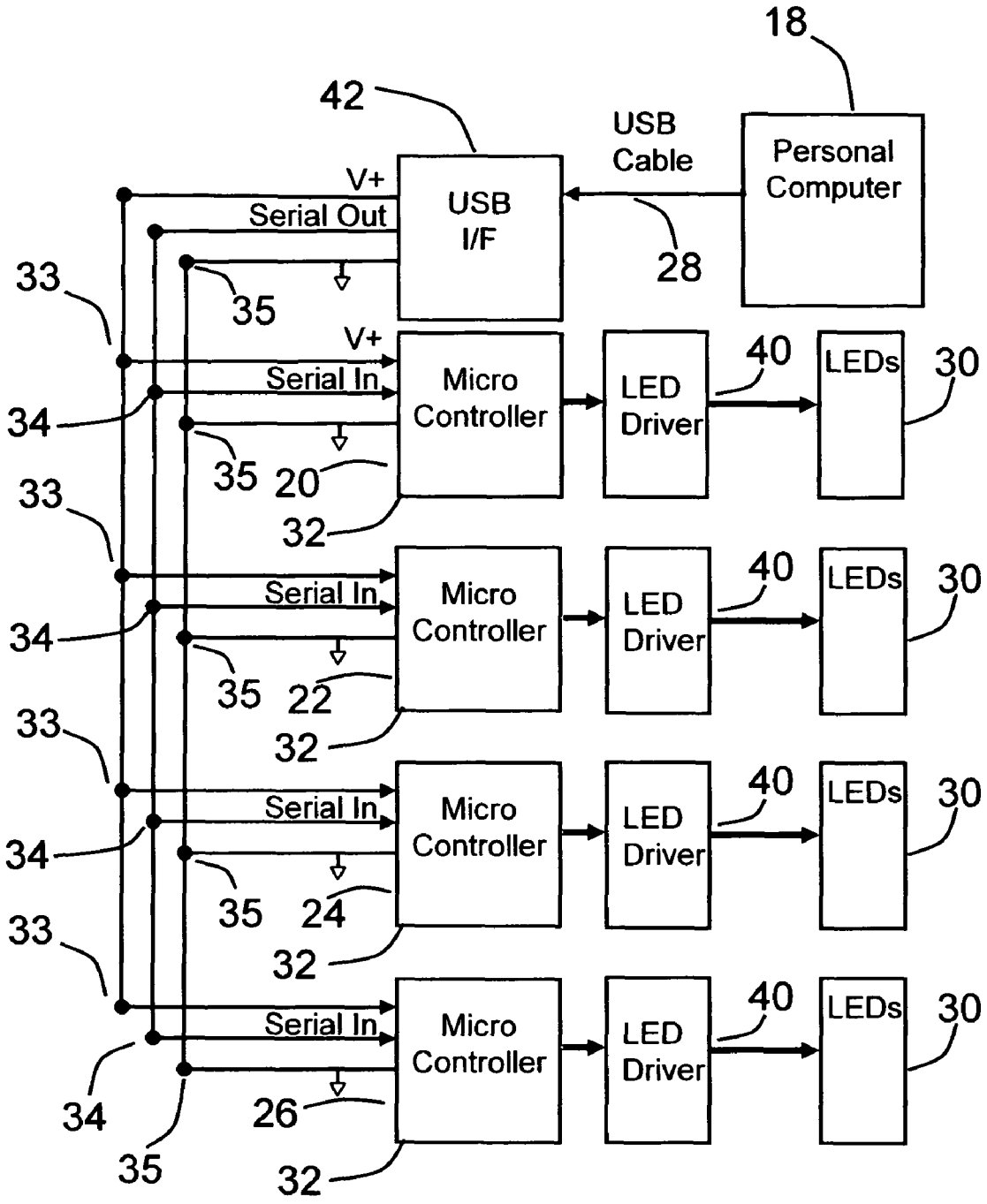
FIG. 5 is a block diagram showing four interconnected microcontroller modules in which the first microcontroller module is equipped with a USB interface that connects to a personal computer.

As shown in FIG. 9, in the preferred embodiment, Pendulum Putting Stroke Training Aid housing 10 comprises four microcontroller module sections 20, 22, 24, and 26 each of which has 12 LEDs uniformly spaced 1 inch apart for a total of 48 LEDs spanning a 4 foot length. Each microcontroller module is connected to a common 3-wire bus and placed inside Pendulum Putting Stroke Training Aid housing 10 which consists of an elongated clear acrylic tube. In the preferred embodiment, the elongated clear tube is straight. However, it would not be inconceivable to those skilled in the art to shape the elongated housing into a curve that resembles the shape of a pendulum arc. Referring now to FIG. 4, a block diagram of the microcontroller module and its connection to personal computer 18 through USB cable 28 is shown. Microcontroller 32 I/O circuitry interfaces and controls 12 LEDs 30*a*-30*l* through LED Driver 40. Microcontroller Serial Data In input 34 receives serial commands from personal computer 18 USB port over USB Cable 28 to USB Interface integrated circuit 42 located on the first microcontroller module. Power +V 33 and ground 35 are derived from the USB bus USB Interface 42. As shown in FIG. 5, four microcontroller modules are interconnected to the three-wire bus which comprises V+ power 33, ground 35, and serial data 34. Serial data out from the USB Interface 42 from personal computer 18 through USB cable 28 is distributed to all four microcontroller Serial In inputs. Only the first microcontroller module 20 includes the USB Interface 42. The USB integrated circuit is not installed on microcontroller modules 22, 24, and 26. Serial data sent from personal computer 18 is received by all four microcontroller modules 20. 22, 24, 26 on every transmission. Each microcontroller module microcontroller 32 is programmed with its local address. The first microcontroller module 20 is programmed with address 0, microcontroller module 22 is programmed with address 1, microcontroller module 24 is programmed with address 2, and microcontroller module 26 is programmed with address 3. During reception of a command byte, these address bits are compared with the address specified within a command byte for a match. If the address matches the local address, the LED number specified within the command is turned on, otherwise all LEDs are turned off in the microcontroller module. LED drivers 40 activate LEDs 30. Refer now to FIG. 9. The first microcontroller module 20 controls LEDs 30*a*-30*l*, the second microcontroller module 22 controls LEDs 30*m*-30*x*, the third microcontroller module 24 controls LEDs 30*y*-30*aj*, and the fourth microcontroller module 26 controls LEDs 30*ak*-30*ay*. FIG. 6 shows a perspective drawing of the first microcontroller module 20 showing the top LED side, while FIG. 7 shows the back side of the first microcontroller module 20 revealing the microcontroller 32, LED Driver 40, and USB Interface 42. As shown in FIG. 6 twelve equally spaced LEDs 30*a*-30*l* are placed 1 inch apart. The three-wire bus connections appear at the rightmost portion of the circuit board at 33, 34, and 35 and appear also at the leftmost end of the microcontroller module. As shown in FIG. 8, two boards are interconnected by inserting jumper wires 36 between identical circuit board pads of the first microcontroller module 20 and the second microcontroller module 22. The same process is used to connect module 22 to the next module (not shown) and so on. In this scheme, power, ground and serial data transmitted from personal computer 18 of FIG. 5 are passed to the next microcontroller module in line.

Figure 11:
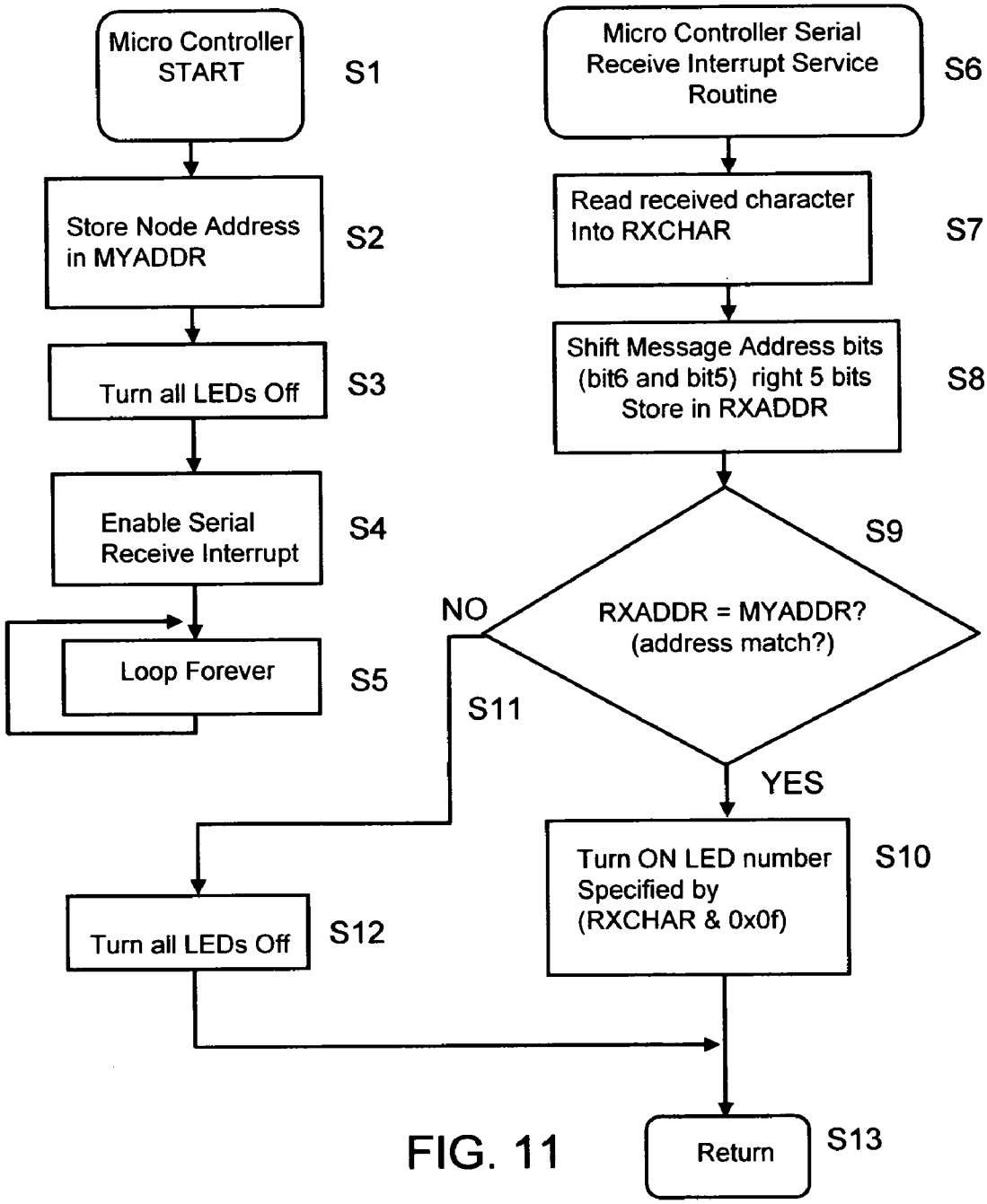
FIG. 11 is a flow chart of the microcontroller software that executes in each of the four microcontroller modules.

Referring to FIG. 11 microcontroller software flow is shown. Step S1 indicates the power up start of the microcontroller program. In step S2, the programmed local bus address (0-3) is read from program memory and placed into a ram variable named MYADDR. This will be used later in the serial receive interrupt service routine step S6. In S3, all LEDs are turned OFF. In step S4, the serial receive interrupt is enabled. In step S5, the microcontroller program stays in a forever background idle loop. When personal computer 18 of FIG. 5 sends an LED command, it consists of an LED number (1-12) and two destination address bits (bit 5 and bit6). When bits 5 and 6 are 0, the LED command is addressed to microcontroller 20. When bit 5 is a 1 and bit 6 is a 0, the second microcontroller 22 is addressed. When bit 5 is a 0 and bit 6 is a 1, the third microcontroller 24 is addressed. And, when bits 5 and 6 are both 1, the fourth microcontroller 26 is addressed. As shown in step S6 of FIG. 11, the microcontroller serial receive interrupt service routine is called when a serial command byte is received from personal computer 18 of FIG. 5. The received byte is stored in RXCHAR in step S7. The address bits are extracted from RXCHAR and shifted into the lower two bits and placed into RXADDR in step S8. In step S9, the received byte's destination address, RXADDR is compared with the microcontroller's local address MYADDR. If the address does not match, step S11, all LEDS are turned OFF in step S12. If the address matches, the command is for this microcontroller and the LED specified in RXCHAR (1-12) is turned ON in step S10. The microcontroller software then, in either case returns back to the background forever loop in step S13.

Figure 12:
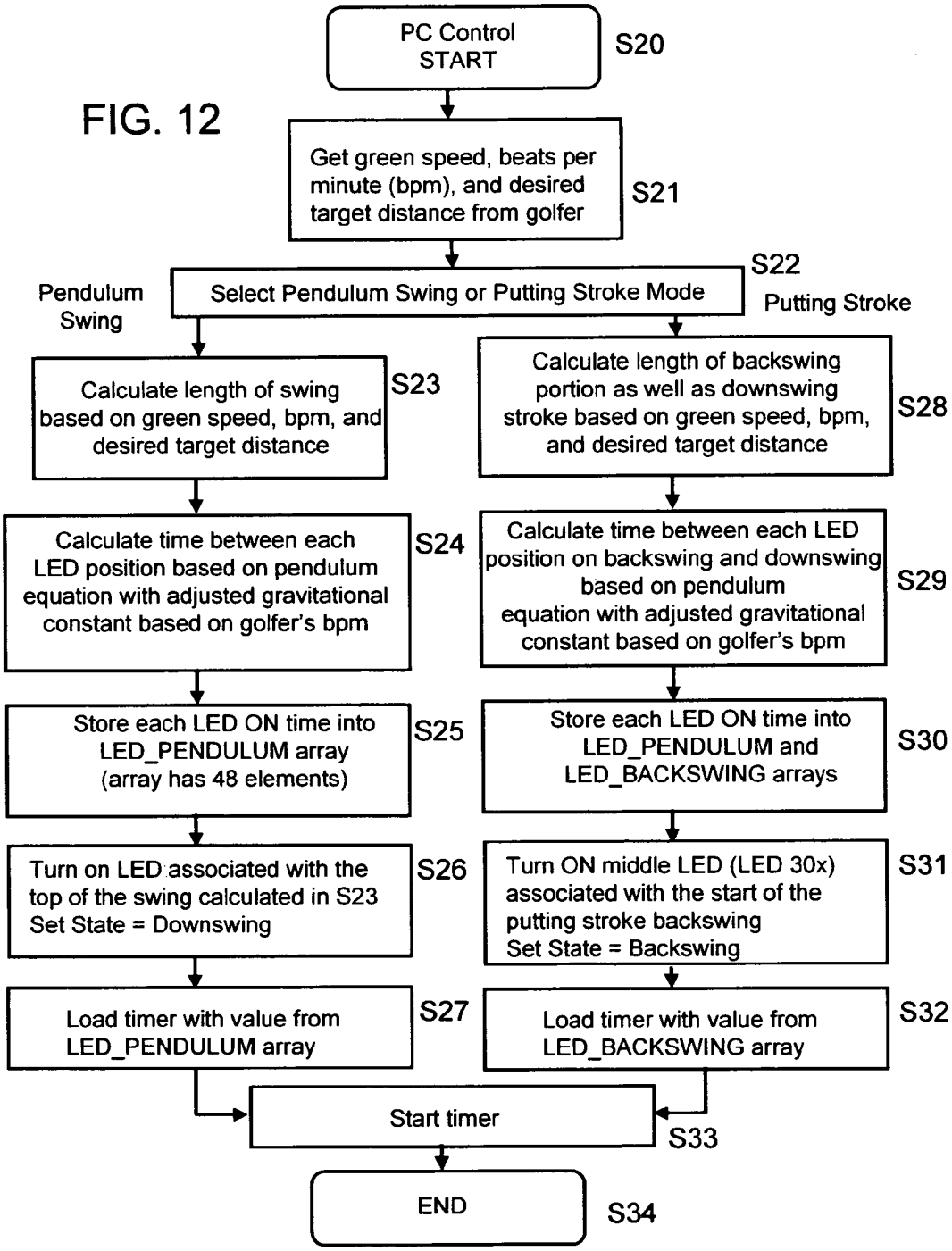
FIGS. 12-14 are flow charts that describe the program flow of the personal computer software that controls the microcontroller modules.

As indicated in FIG. 12, personal computer PC Control software flowchart is shown. The PC Control software starts in step S20. In step S21, the green speed GREENSPEED, beats per minute of the golfer's tempo BPM, and the desired target distance to hit the golf ball DISTANCE is selected by golfer 12 of FIG. 1 prior to stroking golf ball 14 of FIG. 1. There are two main modes of operation of the Pendulum Putting Trainer Aid: Pendulum Swing Mode and Putting Stroke Mode that is selected in step S22. In addition to selecting GREENSPEED, BPM, and DISTANCE, golfer 12 of FIG. 1 selects Pendulum Swing Mode or Putting Stroke Mode on personal computer 18 of FIG. 1.

In Pendulum Swing Mode, LEDs within Pendulum Putting Training Aid enclosure 10 of FIG. 1, "swing" back and forth as a pendulum would do starting at the top of the backswing. Golfer 12 of FIG. 9 swings his/her putter 16 of FIG. 9 in synchronization with the moving LEDs 30*a*-30*av* to get a feel for the pendulum swing. The golfer may increase or decrease the Beats Per Minute selection on the Personal computer 18 to find the tempo that best suits his/her personal timing. The Putting Stroke Mode is used to strike a golf ball a predicted distance guided by the Pendulum Putting Training Aid. It guides the golfer from address in the middle of the Pendulum Putting Training Aid housing 10 of FIG. 9 LED 30*x* to the backswing in which speed gradually builds up to a peak mid way to the top of the backswing, slowing down to a slight stop at the top of the backswing followed by the downswing that builds up speed and reaches maximum speed at impact with the golf ball 14 at the starting position and continuing through to the followthrough shown in FIG. 3.

Pendulum Swing mode begins in S23 of FIG. 12 where, based on GREENSPEED, BPM, and DISTANCE, the length of the pendulum swing is calculated. Each LED (30*a*-30*av*) of FIG. 9 is spaced 1 inch apart. The time for the pendulum to move from one LED position to the next LED in sequence in milliseconds is calculated in step S24 of FIG. 12 for each of the LEDs that comprise the pendulum swing. LEDs that fall outside of the particular pendulum swing resulting from golfer's selections, are not activated. Each LED ON time is stored into LED_PENDULUM array is step S25. This array has 48 elements, one for each of the 48 LEDs used in this embodiment. To begin the pendulum swing, the LED associated with the top of the backswing is turned ON in step S26. State variable, STATE is set to DOWNSWING to indicate to the timer interrupt, that occurs later in the process, which way the pendulum is moving so that the correct next LED will be activated. The timer is loaded with the value from LED_PENDULUM array representing the top of the backswing calculated in step S27 and the timer is started in step S33.

Referring to FIG. 9, in Putting Stroke Mode, LEDs 30*a*-30*av* within Pendulum Putting Training Aid enclosure 10, indicate a real-time putting stroke path from the starting address position as shown in FIG. 9, back towards the top of the backswing as shown in FIG. 2 and down through the impact with golf ball 14 and on to the top of the followthrough as shown in FIG. 3. Golfer 12 of FIG. 9 swings his/her putter 16 of FIG. 9 in synchronization with the moving LEDs 30*a*-30*av* to generate a putting stroke that upon impact with golf ball 14, rolls golf ball 14 the distance selected by golfer 12 on personal computer 18.

Referring back to FIG. 12, Putting Stroke Mode begins in step S28 where, based on GREENSPEED, BPM, and DISTANCE, the length of the stroke backswing is calculated as well as the stroke downswing. In step S29, the time between each LED activation on the backswing is calculated and stored into LED_PENDULUM array in step S30. In step S30, the time between each LED activation on the downswing is stored into LED_PENDULUM array. To begin the putting stroke mode, the LED associated with the middle of the Pendulum Putting Training Aid, LED 30*x* of FIG. 1 is turned On briefly in step S31 to indicate the start of the backswing. State variable, STATE is set to BACKSWING to indicate to the timer interrupt, that occurs later in the process, which way the pendulum is moving so that the correct next LED will be activated. The timer is loaded with the value from LED_BACKSWING array representing the middle of the backswing in step S32 and the timer is started in step S33.

Figure 13:
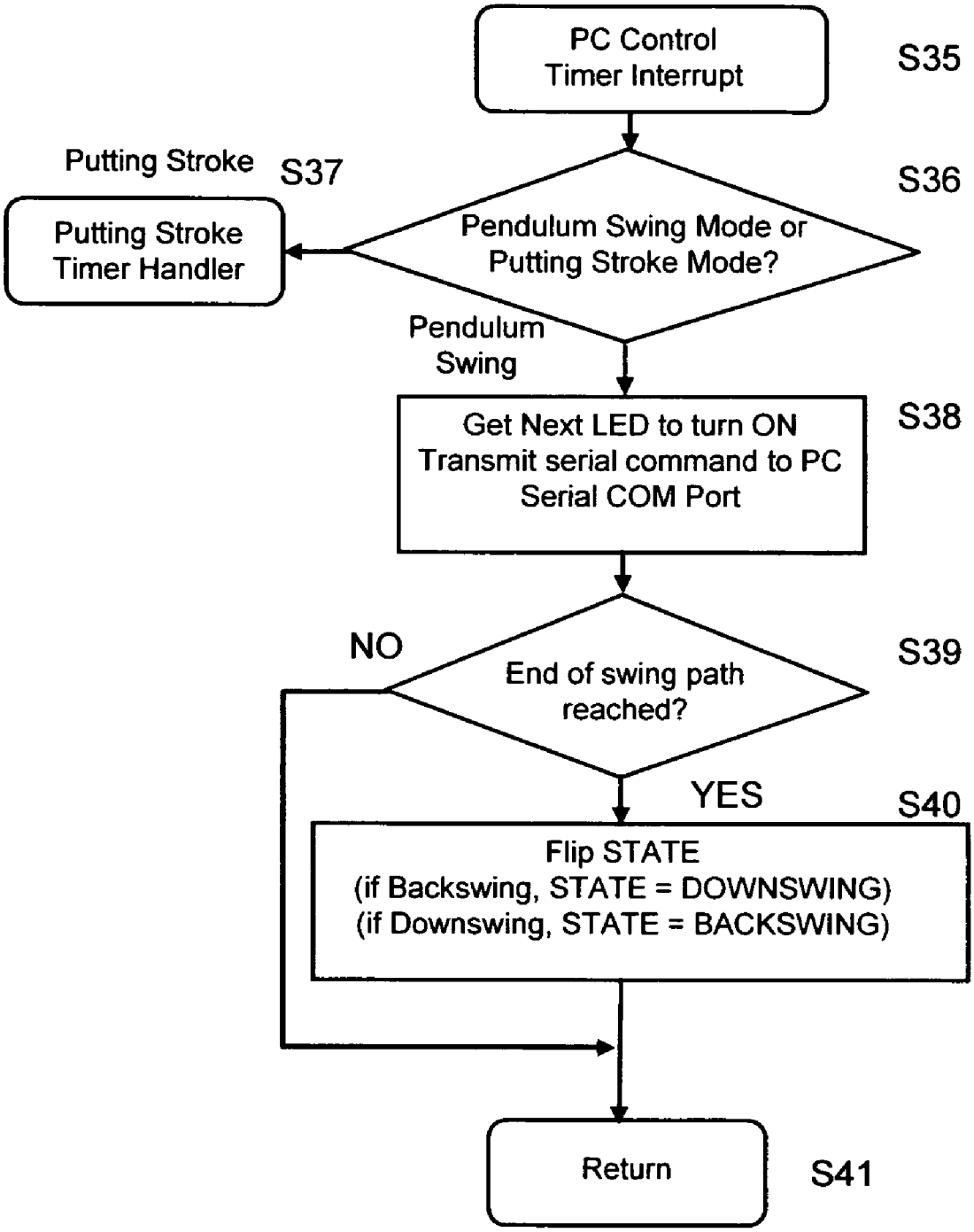

As indicated in FIG. 13, PC Control Timer Interrupt is shown in step S35. Upon timer expiration, step S35 is executed. In step S36, the mode is checked. If MODE is Putting Stroke Mode, program execution branches to Putting Stroke Timer Handler in step S37. If MODE is Pendulum Swing Mode, the next LED to turn ON is transmitted in step 38 to Pendulum Putting Training Aid enclosure 10 of FIG. 1. If the end of the swing path is reached in step S39, STATE is flipped to its opposite state in step S40. Program returns from the timer interrupt service routine in step S41.

Figure 14:
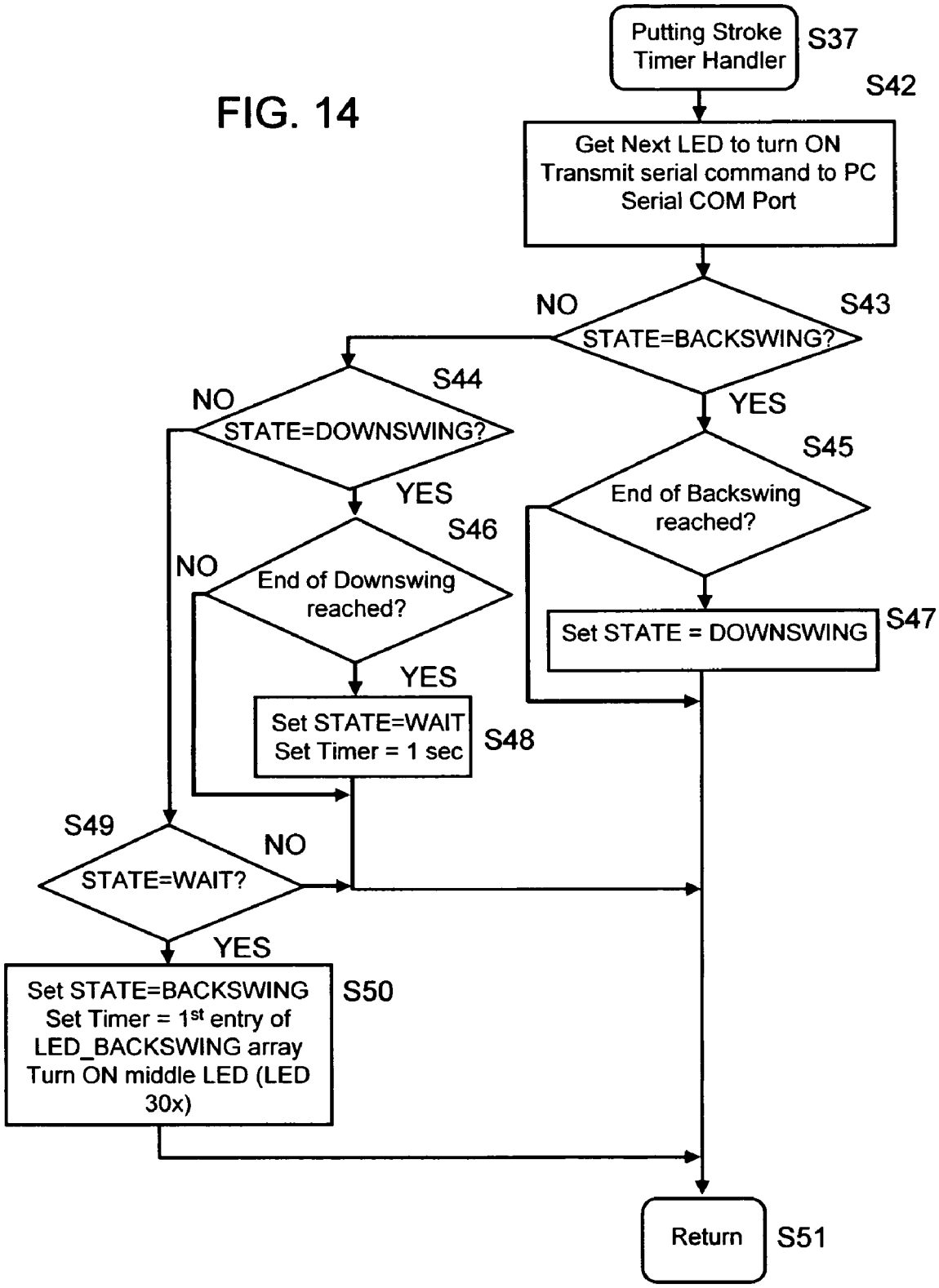

Referring now to FIG. 14, step S37 is the start of Putting Stroke Timer Handler. In step S42, the next LED to activate is determined and transmitted to the Pendulum Putting Training Aid enclosure 10 of FIG. 1. If STATE is BACKSWING in step S43, a check for the end of the backswing is performed in step S45. If the end of the backswing is reached, STATE is flipped to DOWNSWING in step S47 and control is returned back to the background idle loop in step S51. If STATE is not BACKSWING in step S43, step S44 checks if STATE is DOWNSWING. If STATE=DOWNSWING, a check for the end of the downswing is checked in step S46. If the end of the downswing has been reached in step 46, STATE is set to WAIT and the timer is set for ½ seconds in step S48. If STATE is not DOWNSWING in step S44, STATE is checked for WAIT in S49. If STATE is WAIT, STATE is set to BACKSWING, the timer is set to the first entry of LED_BACKSWING array, and the middle LED 30*x* of FIG. 1 is turned on to start another cycle of Putting Stroke Mode in step S50. Control then returns to the background idle loop in step S51.

Figure 10:
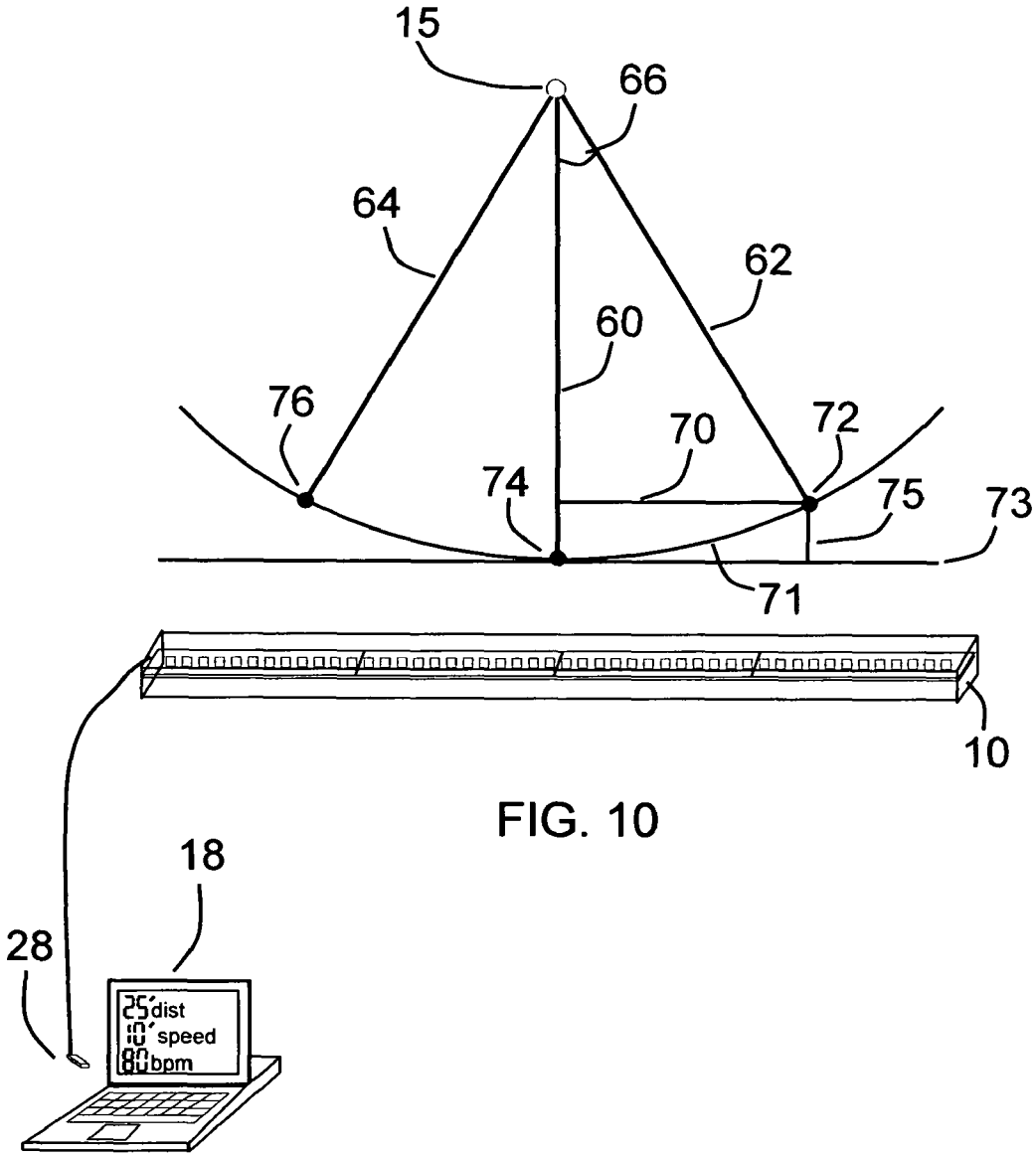
FIG. 10 is a drawing of a putting stroke arc of a backswing and downswing shown above the Pendulum Putting Stroke Training Aid housing and its associated LEDs.

Refer now to FIG. 10 for the description of the equations used to calculate the backswing length 72 and downswing dynamics based on GREENSPEED, BPM, and DISTANCE. The length of the virtual pendulum putter is represented by L 60. The top pivot point of the pendulum diagram is fulcrum 15 as shown in FIGS. 9 and 10. The starting position of the putter head is represented by point 74. The top of the backswing position of the putter head is 72. The angle formed by lines 60 and 62 is angle THETA 66. The length of the pendulum stroke swing would correspond to 72 for the top of the backswing and 76 for the top of the followthrough. Line 64 represents the pendulum putter at the end of the followthrough position. Line x 70 of FIG. 10, is the projection of 72, the top of the backswing, onto x-axis floor plane 73. Height h 75 is the height of the putter head 75 above floor plane x 73. The arc representing the path of the putter head from address position to the top of the backswing is 71. Pendulum Putting Training aid housing 10 is placed on the putting surface and is controlled by Personal Computer 18 through USB cable 28.

Given a desired target golf ball roll distance, selected green speed to simulate, pendulum putter length, putter head mass, and personal putting tempo, the object of the invention is to show a practicing golfer through equally spaced visual indicators the putting stroke backswing and downswing dynamics which, if followed, will result in a putting stroke that will roll a golf ball the desired distance.

Given a desired target distance, Distance, and a selected green speed, Greenspeed, the initial required golf ball speed, Vball can be calculated from:

$$V\text{ball}=sqrt[(36.1*\text{Distance})/\text{GreenSpeed}]$$

Using conservation of momentum for a putter head striking a golf ball, Vball is the velocity of the golf ball after impact. Vputter is the velocity of the putter head before impact. The equation for the velocity of the ball after impact is:

$$V\text{ball}=[(1+e)/(1+M\text{ball}/M\text{putter})]V\text{putter}$$

where e is the coefficient of restitution of the ball and the putter head, Mputter is the mass of the putter head, and Mball is the mass of a golf ball. A typical putter head mass is 325 g while a golf ball is 46 g. The coefficient of restitution between the steel putter head and a golf ball is approximately 0.78.

Given the initial ball speed, Vball, and Putter Head mass, Mputter, the required putter head speed to achieve Vball speed is:

$$V\text{putter}=[(1+M\text{ball}/M\text{putter})/1.78]*V\text{ball}$$

Given the putter speed at impact of Vputter, the height, h, at which the pendulum putter would need to start to reach Vputter at the bottom of the arc would be:

$h=(V\text{putter}\hat{}2)/(2g)$, where g in the gravitational acceleration constant of 32.2 ft/sec^2.

However, instead of using a gravitational constant of 32.2 ft/sec^2, an equivalent g' will be developed taking into consideration the golfer's personal putting tempo rate.

The equation for ½ period (one way swing) of a pendulum of length L, is:

$T=pi*sqrt[L/g]$, where g is the gravitational acceleration constant of 32.2 ft/sec^2 and pi is 3.14159

The golfer's personal tempo is expressed in beats per minute (BPM). The period, T expressed in seconds is:

$T=60/\text{BPM}$

Setting the golfer's personal putting tempo period of 60/BPM equal to the period of a pendulum:

$60/\text{BPM}=pi*sqrt[L/g']$ g' in the above equation represents the equivalent gravitational constant based on the golfer's personal tempo.

Solving for g':

$g'=L*\text{BPM}/365$

A standard putter is approximately 36 inches long. However, in executing a "pendulum" stroke where the arms and shoulders move back and forth with little hand action, the effective length of the putter when considering it as a pendulum is longer than 36 inches due to the fact that a properly executed pendulum stroke points the butt of the grip just above the golfer's navel throughout the stroke. This point is approximately 44 inches or 3.7 feet on an average adult male. This point is the virtual fulcrum of a standard length putter projected towards the golfer and is shown as item 15 in FIG. 9 and FIG. 10. Letting L=3.7 feet, the period of one swing of the pendulum putter is:

$T=3.14159*sqrt[3.7/32.2]=1.06$ seconds

This corresponds to a swing rate of: (60 sec/min*(1/1.06 sec)=56.3 beats per minute.

Most professional golfers exhibit an actual swing tempo rate in the range of 70 to 120 beats per minute whereas a true pendulum rate would be 56 beats per minute. A golfer therefore, would not perform a true pendulum stroke in most cases in that it would be too slow. The pendulum however will be used as a model for a proper stroke in regard to its smooth gravitational acceleration aspects, but not its exact timing. In order to develop equations of motion for the putting stroke while taking into account actual swing rates of expert golfers, a modified gravitational constant g' is used. The g' utilized is an equivalent gravitational constant based on the personal tempo rate of the golfer. For a given golfer personal tempo rate, a corresponding g' is used to generate the equations of motion for the putting stroke.

For example, if the golfer's personal tempo rate is 80 beats per minute, the equivalent g' would be: 65 ft/sec^2 approximately twice that of Earth's gravity.

Refer to FIG. 10. With the equation for g', the peak speed of the putter at impact can be determined from Vputter=sqrt [2g'h], where h is the height 75 of the top of the backswing above the floor plane 73.

In terms of h:

$h=(V\text{putter}^2)/2g'$

The backswing length x 71 can be determined from the height h 75 from:

$x=sqrt[L^2-(L-h)^2]$.

Therefore, for a given desired golf ball roll distance, x is the backswing starting position that will yield a downswing stroke following gravitational acceleration constant g' that will result in the target golf ball roll distance.

The goal of the calculations is to determine the putter pendulum backswing height h 75, that will yield a maximum pendulum putter downswing velocity at impact using the equivalent g' based on the golfer's personal tempo rate such that after collision with putterhead 17 of FIG. 1, golf ball 14 of FIG. 1 will roll a desired distance based on a given green speed. In usage, the golfer selects distance, personal tempo rate, putter head mass, pendulum putter length, and green speed on personal computer 18 of FIG. 1 and the Pendulum Putting Stroke Training Aid shows the golfer the proper swing path dynamics through illuminating LEDs 30*a*-30*av* of FIG. 9 to strike golf ball 14 a desired distance.

In another embodiment of the Pendulum Putting Stroke Training Aid, a generate audio file button feature within the graphical user interface running on personal computer 18 of FIG. 1 generates a sound file that can be loaded onto personal music players. Pressing the generate audio file button (not shown) generates multiple cycles of a putting stroke at the tempo rate selected. The resulting personal computer sound file can then be listened to by the golfer on a green while practicing putting. Refer to FIG. 9. For each time increment between LEDs, n cycles of a phase continuous frequency related to the height of putterhead 17 are generated and stored in a personal computer way file. A special beep sound is placed in the file at the precise moment of impact of putterhead 17 with golf ball 14. By listening to the resulting audio file, the golfer 12 is provided with an audio version of the Pendulum Putting Stroke Training Aid that he/she can take to the practice putting green.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus used to train a golfer how to make a proper putting stroke with a putter by guiding said golfer with a plurality of visual cues indicative of a time position accelerative sequence of said proper putting stroke comprising:

a) An elongated housing of about four feet in length comprising a clear plastic tube about three quarters of an inch in diameter which is placed lengthwise on a putting surface parallel to and a few inches outside the intended stroke path made by said golfer using said putter such that during address the line made by the face of said putter aligns laterally with the middle of said clear plastic tube;

b) A microcontroller module comprising a low cost microcontroller, a serial receive port programmed to respond to a unique address, a printed circuit board of about 1 foot in length and narrow enough in width to fit within said elongated housing, a plurality of uniformly spaced linearly arranged visual indicators mounted on said printed circuit board, a 3 wire serial command bus further comprising a power line, a serial receive data line and a ground line, said 3 wire serial command bus extending from input terminals on one end to output terminals on the other end of said printed circuit board, wherein a plurality of said microcontroller modules are physically interconnected together and mounted within said elongated housing with said output terminals of one module tied to said input terminals of the next to form a subsystem responsive to commands to turn on one of said plurality of uniformly spaced linearly arranged visual indicators over said 3 wire serial command bus;

c) A peripheral computing device comprising a user interface with which to obtain a set of putting stroke parameters and a serial transmit port which connects to said 3 wire serial command bus, said user interface comprises a personal tempo in beats per minute selector, a green speed selector, and a target roll distance selector, wherein said peripheral computing device computes an accelerative sequence of putterhead positions associated with said set of putting stroke parameters and issues resulting commands to said serial transmit port wherein said plurality of uniformly spaced linearly arranged visual indicators show said golfer said proper putting stroke.

2. The apparatus of claim 1 in which said plurality of uniformly spaced linearly arranged visual indicators are LEDs.

3. The apparatus of claim 2 in which said peripheral computing device is a personal computer with a graphical user interface and a host side universal serial bus, the first said microcontroller module within said elongated housing is equipped with a slave side universal bus to serial interface which interfaces said personal computer on the universal serial bus side and said 3 wire serial command bus on the other.

4. The apparatus of claim 3 in which said peripheral computing device is a personal digital assistant.

5. A computer readable medium useful in association with a computer which includes a processor, a memory, a timer, a user interface and a serial port, the computer readable medium including computer instructions which are configured to cause the computer to create and transmit a timed sequence of commands over a serial command bus to a plurality of microcontroller modules each which controls a plurality of uniformly spaced linearly arranged visual indicators, said plurality of microcontroller modules being mounted within an elongated housing comprising a clear plastic tube and having an interface to said serial command bus for the reception of said timed sequence of commands in order to guide a golfer on how to strike a golf ball a target roll distance with a preferred putting stroke by:

a) Inputting a green speed, said target roll distance, and a personal tempo rate in beats per minute from said golfer;

b) Computing an initial speed of said golf ball required for said target roll distance based on said green speed;

c) Computing a putter clubhead speed necessary to strike said golf ball said target roll distance based on said green speed;

d) Computing an acceleration constant based on said personal tempo rate in beats per minute;

e) Computing an equivalent maximum pendulum putter clubhead height off the ground using said acceleration constant to yield a maximum speed equal to said putter clubhead speed necessary to strike said golf ball said target roll distance based on said green speed;

f) Computing a backswing length and a downswing length based on said equivalent maximum pendulum putter clubhead height;

g) Generating a table of on times for each of a selected subset of said plurality of uniformly spaced linearly arranged visual indicators that fall within said backswing length, wherein said table of on times sets the time delay between visual indicator command transmissions;

h) Transmitting visual indicator activation commands in time based on the contents of said table of on times in order to accurately space transmissions and show said golfer how to execute a preferred putting stroke that will roll golf ball said target roll distance based on said green speed and said personal tempo rate in beats per minute.

6. The method of claim 5 in which said a plurality of uniformly spaced linearly arranged visual indicators are leds.

7. The method of claim 6 in which said computer readable medium is a personal computer comprising a graphical user interface.

8. The method of claim 7 in which said serial command bus is a universal serial bus port.

9. A computer system comprising:

a processor;

a memory operatively coupled to the processor;

a serial command bus;

a user interface operatively coupled to the processor; and a visual indicator controller module which, when executed in the processor from the memory and which, when executed by the processor, causes the processor to create and transmit a sequence of commands over a serial command bus to a plurality of microcontroller modules each which controls a plurality of uniformly spaced linearly arranged visual indicators said plurality of microcontroller modules being mounted within an elongated housing comprising a clear plastic tube and having an interface to said serial command bus for the reception of said sequence of commands in order to guide a golfer on how to strike a golf ball with a preferred putting stroke by a) Inputting a green speed, a roll distance, and a personal tempo rate in beats per minute from said golfer, b) Computing an initial speed of said golf ball required for said roll distance based on said green speed;

c) Computing a putter clubhead speed necessary to strike said golf ball said roll distance based on said green speed;

d) Computing an acceleration constant based on said personal tempo rate in beats per minute;

e) Computing an equivalent maximum pendulum putter clubhead height off the ground using said acceleration constant to yield a maximum speed equal to said putter clubhead speed necessary to strike said golf ball said roll distance based on said green speed;

f) Computing a backswing length and a downswing length based on said equivalent maximum pendulum putter clubhead height;

g) Generating a table of on times for a selected subset of said uniformly spaced linearly arranged visual indicators that fall within said backswing length and said downswing length from said plurality of visual indicators;

h) Activating said selected subset of said uniformly spaced linearly arranged visual indicators in an accelerative sequence by transmitting visual indicator commands spaced apart in time based on the contents of said table of on times over said serial command bus to said plurality of microcontroller modules within said elongated housing in order to show said golfer how to execute a preferred putting stroke that will roll said golf ball said roll distance based on said green speed and said personal tempo rate in beats per minute.

10. The computer system of claim 9 in which said computer system is a personal computer comprising a graphical user interface.

11. The computer system of claim 10 in which said serial command bus is a universal serial bus.

* * * * *